US005111581A

United States Patent [19]

Collins

[11] Patent Number: 5,111,581

[45] Date of Patent: May 12, 1992

[54] BOLT OPERATED LOCKING MECHANISM FOR FOLDING KNIFE

[76] Inventor: Walter W. Collins, P.O. Box 100, North, S.C. 29112

[21] Appl. No.: 788,489

[22] Filed: Nov. 6, 1991

[51] Int. Cl.[5] ..... B26B 1/04; B26B 1/00; B26B 1/06

[52] U.S. Cl. ..... 30/161; 30/160; 30/158

[58] Field of Search ..... 30/160, 161, 159, 158, 30/155, 154, 153

[56] References Cited

U.S. PATENT DOCUMENTS

| | | | |
|---|---|---|---|
| 598,896 | 2/1898 | Berglund . | |
| 631,547 | 8/1899 | Miller . | |
| 1,428,296 | 9/1922 | Neft . | |
| 1,614,949 | 1/1927 | Finley . | |
| 2,188,762 | 1/1940 | Schrade | 30/160 |
| 2,286,524 | 6/1942 | Wilbur | 30/161 |
| 2,461,941 | 2/1949 | Sutton | 43/5 |
| 2,924,879 | 2/1960 | Kraus, Jr. | 30/151 |
| 3,868,774 | 3/1975 | Miori | 30/161 |
| 4,451,982 | 6/1984 | Collins | 30/161 |
| 4,573,268 | 3/1986 | Call | 30/161 |
| 4,719,700 | 1/1988 | Taylor, Jr. | 30/158 |
| 4,730,394 | 3/1988 | Sonner, Jr. | 30/161 |
| 4,811,486 | 3/1989 | Cunningham | 30/161 |
| 4,893,409 | 1/1990 | Poehlmann | 30/161 |
| 4,918,820 | 4/1990 | Korb et al. | 30/161 |

FOREIGN PATENT DOCUMENTS

| | | |
|---|---|---|
| 181973 | 3/1907 | Fed. Rep. of Germany . |
| 1248117 | 10/1959 | France . |
| 465320 | 10/1960 | Italy . |
| 6296 | 1/1808 | Norway . |
| 2872 | of 1913 | United Kingdom . |

*Primary Examiner*—Douglas D. Watts
*Assistant Examiner*—Paul M. Heyrana, Sr.
*Attorney, Agent, or Firm*—Michael A. Mann

[57] ABSTRACT

A locking, folding knife or tool comprising a handle with a groove dimensioned to receive a knife blade or other instrument that pivots about an integral pivot post between a closed position in the groove and an extended position. The pivot post fits into a hole in the blade of the knife which has two cutout portions along the periphery of the hole. The pivot post has an additional cutout portion. The handle carries a bolt for pushing a spring biased transfer bar toward the blade thereby disengaging a locking pin from one of the cutout portions of the blade and engaging the cutout portion of the pivot post so that the blade can pivot freely about the pivot post. The first cutout portion locks the blade in the extended position; the second cutout portion retains but does not lock the blade in the closed position. Additionally, a strut pivoting between the transfer bar and the handle can be included for added security in the locking of the blade. Contouring of the handle assures that the bolt operating thumb of the user is forward of the bolt and thus cannot operated the bolt without a conscious effort to replace the thumb rearward onto the bolt and pushing forward.

9 Claims, 3 Drawing Sheets

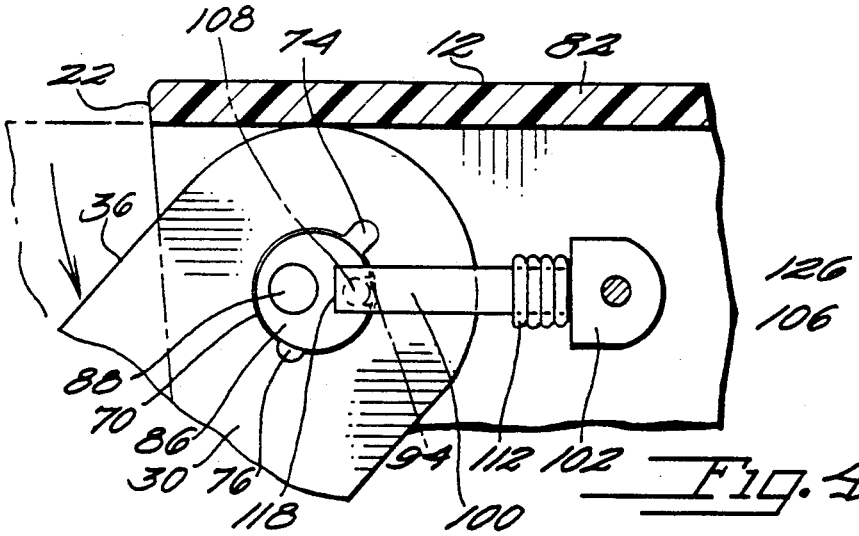
Fig. 4a.
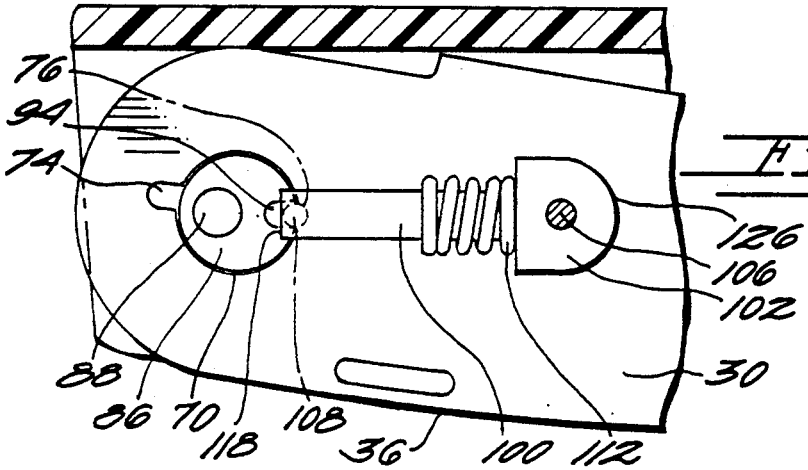
Fig. 4b.
Fig. 5.
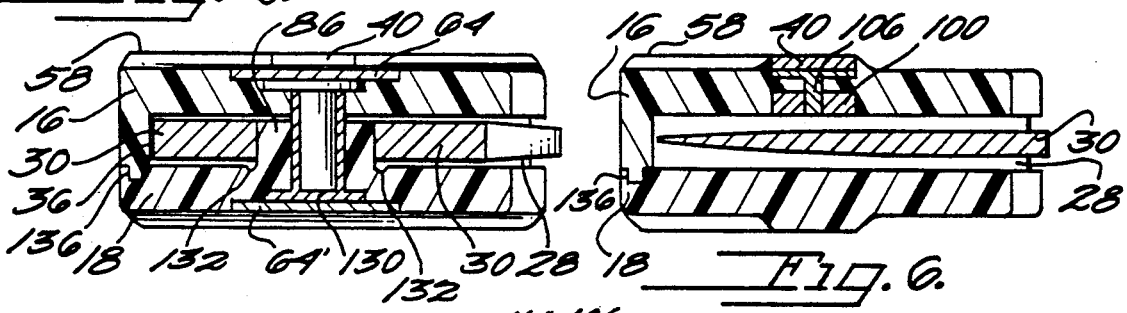
Fig. 6.
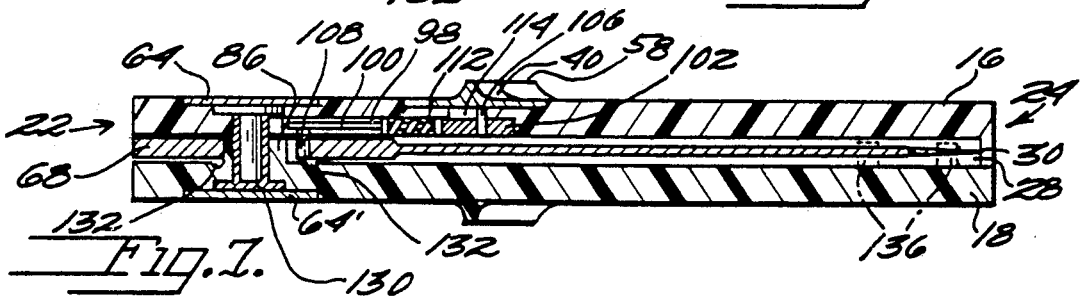
Fig. 7.

BOLT OPERATED LOCKING MECHANISM FOR FOLDING KNIFE

BACKGROUND OF THE INVENTION

1. Field of the Invention

The present invention relates generally to knives and tools having blades or implements that fold into a recess in a handle when not in use. In particular, the present invention relates to folding knives having locking mechanisms for securing the blade of the knife in the extended position.

2. Discussion of Background

The folding knife art has been the subject of a considerable number of innovations through the years. Many folding knife innovations are related to safety. A knife, being sharp and designed to cut, is capable of inflicting serious injury to the user if carelessly handled. Even if the user is not unnecessarily careless, accidents can happen. Knife design can eliminate some, but not all, knife-handling accidents.

Of the safety improvements that have been made in folding knives, perhaps the most important is the locking blade, a blade that is locked in its extended position so that it does not accidentally close on the fingers of the user.

There are great many locking mechanisms, but in particular, bolt operated locking mechanisms are not new. U.S. Pat. No. 598,896 issued to Berglund in 1889 and U.S. Pat. No. 631,547 issued to Miller in 1899 are two early examples of bolt actuated locking mechanisms. More recently, bolt locking mechanisms that are mounted on the side of the handle are found in U.S. Pat. No. 4,893,409 issued to Poehlmann and my U.S. Pat. No. 4,451,982.

Because a folding knife is a tremendously useful instrument, it should be easy to use. The knife should be designed so that it is comfortable when grasped by the user for the task intended. The locking mechanism should be a natural part of the knife, not interfering with the grasp of the handle by the user. It should be easy to operate but not so easy that the blade could be unlocked accidentally. The locking mechanism must be simple in design so as not to add undue cost or complexity to the knife or tool but be effective, reliable, sure.

SUMMARY OF THE INVENTION

According to its major aspects, the present invention is a folding knife or tool having a handle with a longitudinal groove and an implement, such as a knife blade, pivotally attached to one end of the handle so that it can be pivoted into the groove. The implement is locked in an extended position and retained, but preferably not locked in the closed, that is, folded position. The handle carries a bolt on a side to operate the locking mechanism by sliding the bolt forward, toward the implement, rather than away from it, to unlock the implement. The sides of the handle are contoured so that the thumb of the user is comfortably urged toward the front of the handle, forward of the bolt, so that the thumb must be repositioned rearward, on the bolt, to operate it.

The implement pivots about an integrally molded pivot post. There are two cutout portions along the periphery of the hole in the implement that receives the pivot post, a larger one and a smaller one. The bolt operates a spring-biased transfer bar which moves a locking pin into and out of engagement with these cutout portions. Engagement of the locking pin with the larger cutout portion locks the implement in the extended position; engagement with the smaller cutout portion retains implement in the closed position. A strut carried at one end by a transverse groove on the inside of the handle and at the other end by the transfer bar may be employed to increase the strength of the bolt-operated locking mechanism.

It is a feature of the present invention that the device of the present invention locks the implement in the extended position and retains it in the closed position. Locking the implement in the extended position is for safety, so that the implement does not close on the finger of the user. Retaining the implement in the closed position is also a safety feature because the user knows, as the implement slips into the retained position, that it is fully seated in the groove. However, use of the implement by pivoting the implement from the closed position to the open position does not require unlocking the blade. Such a feature, locking the blade in the closed position, is an alternative embodiment of the present invention and is simply achieved by making both cutout portions large.

It is another feature of the present invention that the pivot post is integral with the handle. In the preferred embodiment, the handle has a small depression about the base of the pivot post and the handle is made of plastic, most preferably a durable plastic such as NYLON. The feature of an integral pivot post allows the post to be molded with the balance of the handle, greatly simplifying manufacturing. The circular depression prevents undue wear of the integral, molded pivot post.

Another feature of the present invention is the direction the bolt must be moved to disengage the locking mechanism, namely forward toward the blade or other implement. It is believed that it is more likely the hand of the user would tend to slide toward the rear of the handle so the bolt of the present invention will not disengage if the hand of the user passes over it in that direction.

Yet another feature of the present invention is the contour of the handle and the contour in cooperation with the bolt. The contour is designed for comfort and also to urge the thumb of the user to a position forward of the bolt so that the thumb is not resting on the bolt nor behind it where, if the hand of the user should slip, the bolt could be accidentally moved forward to disengage the locking mechanism. The thumb must be consciously lifted and moved rearward to operate the bolt.

Another feature of the present invention is the strut for adding strength to the locking mechanism. Especially for larger or heavy duty knives, the strut can hold the locking pin in line for movement between the cutout portions.

These and other features and advantages of the present invention will be apparent to those skilled in the art from the following detailed description and the accompanying drawings.

BRIEF DESCRIPTION OF THE DRAWINGS

In the drawings,

FIG. 4*a* is a detail of a cut away view of locking mechanism with the blade of the knife being rotated between the extended and closed positions;

FIG. 4*b* is a detail of a cut away view of the locking mechanism with the blade of the knife retained by the locking mechanism in the closed position;

FIG. 5 is a cross sectional view along line 5—5 of FIG. 1;

FIG. 6 is a cross sectional view along line 6—6 of FIG. 1;

FIG. 7 is a cross sectional view along line 7—7 of FIG. 1;

DETAILED DESCRIPTION OF THE A PREFERRED EMBODIMENT

The present invention is a device such as a folding knife or other folding tool having an implement that folds into a groove in a handle. A folding knife with a blade as the implement, according to the present invention, will be described herein, however, it will be seen that the structures, functions and materials described may be translated directly to other tools that may be folded for convenience and safety.

Figure 1:
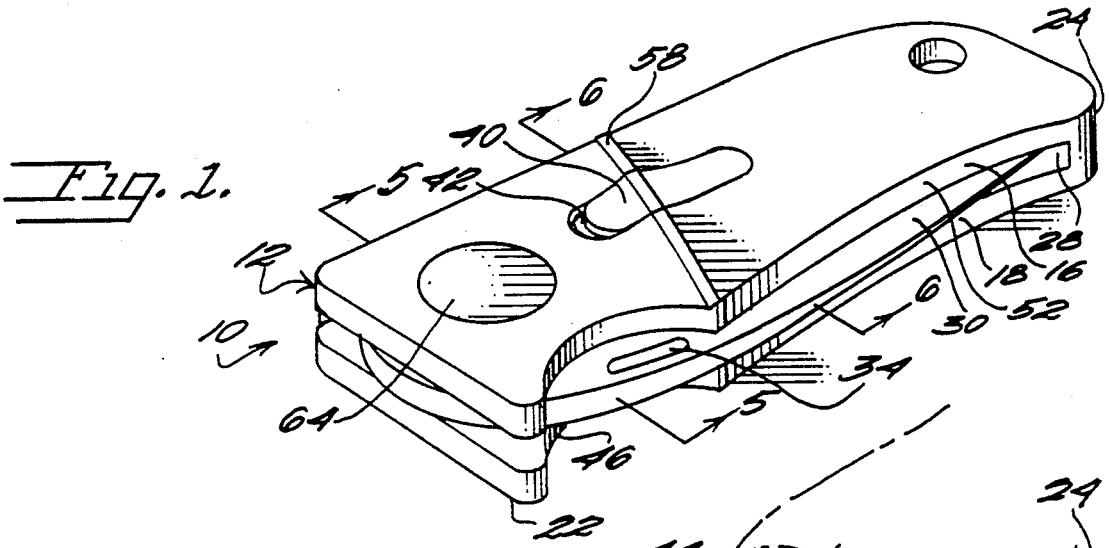
FIG. 1 is a perspective view of a preferred embodiment of the present invention as a folding knife with the blade in the folded position.
Figure 2:
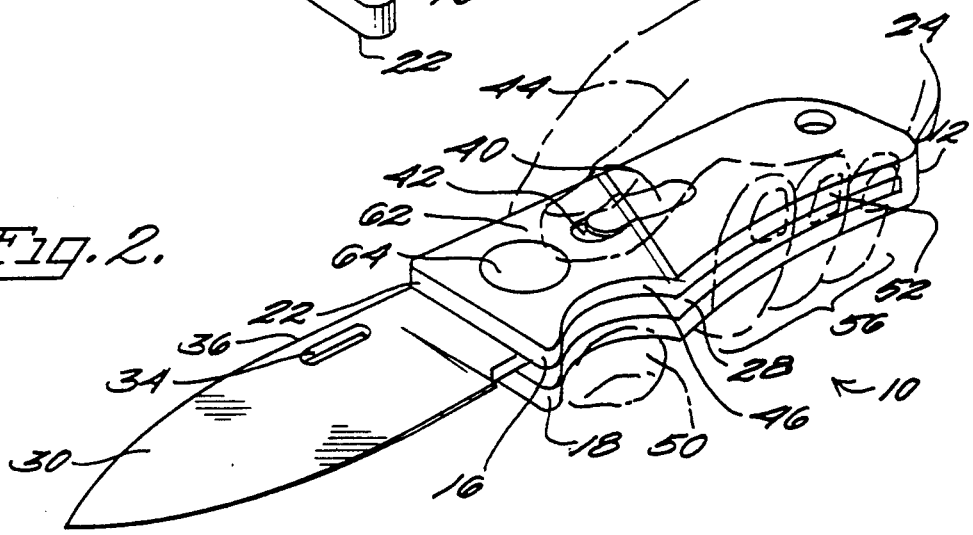
FIG. 2 is a perspective view of a preferred embodiment of the folding knife of FIG. 1 with the blade in the extended position with a suggestion of a hand holding the knife by the handle.

In FIGS. 1 and 2 is shown a folding knife 10 according to the present invention. Knife 10 comprises a handle 12 having a first side 16, a second side 18, a first end 22 and a second end 24. First and second sides 16, 18 are separated to define a longitudinal groove 28 running from first end 22 to second end 24.

A blade 30 is pivotally attached to handle 12 at first end 22 in a manner to be more fully described below. Blade 30 has a cutout slot 34 along the back 36 of blade 30 to facilitate pivoting blade 30 from a closed position (FIG. 1) in which blade 30 is fully seated in groove 28 to an extended position (FIG. 2).

A bolt 40 sliding in a shallow channel 42 is carried by first side 16, or by second side 18 for left handed users. Bolt 40 is part of the locking mechanism to be described below. Bolt 40 is slid forward, toward first end 22, to unlock blade 30 and rearward, toward second end 24, to lock blade 30.

First and second sides 16, 18 of handle 12 are contoured in part for comfort. FIG. 2 shows the normal position of a hand 44 of a user on handle 12. The curve at 46 facilitates the wrapping of the index finger 50 of the user about handle 12. The curve at 52 facilitates the wrapping of the middle, third and fourth fingers 56 of the user around handle 12. First and second sides 16, 18 of handle 12 are also contoured, rising or bulging outward to a high point at 58 that crosses bolt 40. Bolt 40 is contoured to be flush with the contours of first side 16.

In use, the contour of first side 16 urges the user to place his thumb 62 forward of high point 58, and thus forward of bolt 40, near first end 22, rather than on high point 58, which would not be comfortable, or rearward, toward second end 24 where the user would feel he or she had insufficient length of handle 12 in his or her grip.

Because bolt 40 unlocks blade 30 when slid forward, slippage of the users hand rearward would not result in an unlocking movement of bolt 40. Slippage forward would not bring the thumb of the user in contact with the bolt at all. The user must consciously move his thumb 62 rearward to bolt 40 and then push forward to unlock blade 30.

To finish the external appearance of handle 12, a pair of pivot covers 64, 64' (only one, 64, the one on first side, is shown in FIGS. 1 and 2) cover part of the pivoting and locking mechanism, which will now be described by referring to FIG. 3.

Figure 3:
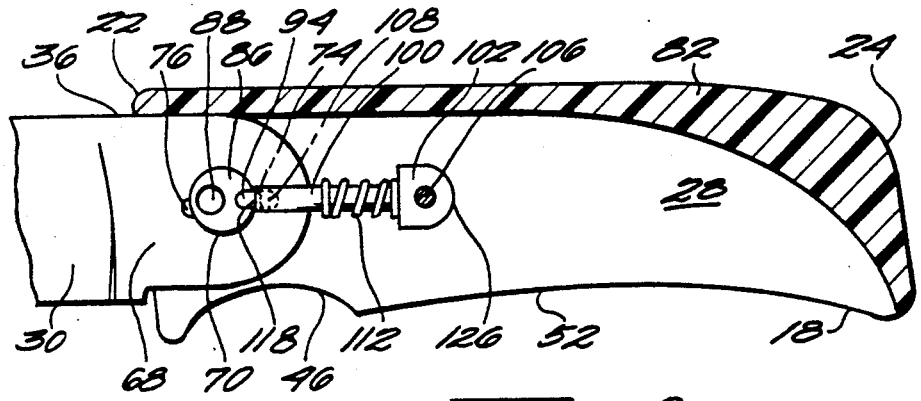
FIG. 3 is a cross sectional side view of the folding knife of the present invention showing the locking mechanism and the blade of the knife in the extended position.

FIG. 3 shows a cut away side view of knife 10. Blade 30 has a tang 68 having a hole 70 with two cutout portions, a larger first cutout portion 74 and a smaller second cutout portion 76. First and second cutout portions 74, 76 are less than but nearly 180 degrees apart because the closed and extended positions of blade 30 are nearly 180 degrees apart.

The inside of second side 18 is shown with a recessed area 80 that forms a part of groove 28 and a thickened part 82 that will join with first side 16, as will be described, to form handle 12. Thickened portion 82 extends from second end 24 to first end 22 and helps to hold tang 68 of blade 30 securely in position by engaging a portion of back 36 of blade 30. Second side 18 has a pivot post 86 which is preferably an integral part of second side 18, and most preferably formed at the same time as second side 18, such as by molding. Pivot post 86 has a hole 88 for a pivot pin 92 and a third cutout portion 94.

In addition to bolt 40, additional components of the locking mechanism are shown in FIGS. 3, 4*a*, 4*b*, 6 and 7. In FIGS. 3, 4*a* and 4*b* these components are shown above second side 18 in position to cooperate with blade 30 and the three cutout portions 74, 76, 94. FIGS. 6 and 7 show these components of locking mechanism in a recess 98 in first side 16 and their connection with bolt 40.

Part of the locking mechanism includes a transfer bar 100 with an enlarged head 102, a bolt pin 106, a locking pin 108 for engaging cutout portions 74, 76, 94, and an oval coil spring 112 having a diameter smaller than enlarged head 102. Bolt pin 106 is attached to bolt 40 through an elongated hole 114 in first side 16 (FIGS. 6 and 7) and attached firmly to one end 118 of transfer bar 100 so that, as bolt 40 slides between a first and second position at the opposing ends of channel 42 on handle 12, bolt pin 106 and consequently transfer bar 100 slide toward and away from first end 22 of handle 12. At the opposing end 126 of transfer bar 100, is locking pin 108 which fits into first, second and third cutout portions, 74, 76, 94, respectively. Locking pin 108 and the three cutout portions, 74, 76, 94 are preferably round with locking pin 108 have a slightly smaller radius of curvature than three cutout portions, 74, 76, 94 so that locking pin 108 seats easily but snugly in each.

Spring 112 compresses when transfer bar 100 with enlarged head 102 is moved toward first end 22 so that spring 112 biases transfer bar 100 toward second end 24 and away from first end 22 and bolt 40 is biased rearward. Third cutout portion 94 is aligned with the long axis of transfer bar 100. First cutout portion 74 is located so that, when blade 30 is in extended position, locking pin 108, urged toward second 24 end by spring 112, moves locking pin 108 into first cutout portion 74 to hold blade 30 locked, assisted by second side's 18 thickened area 82 engaging back 36 of blade 30.

When bolt 40 is pushed toward first end 22 (FIG. 4*a*), locking pin 108 is moved out of first cutout portion 74 into third cutout portion 94 so that blade 30 is no longer prevented from pivoting about pivot post 86 from extended position. Pivoting blade 30 to closed position brings second cutout portion 76 in alignment with locking pin 108. Spring 112 biases locking pin 108 into second cutout portion 76 from third cutout portion 94. Third cutout portion 94 has a depth that is preferably less than half the diameter of locking pin 108 so that it retains but does not lock blade 30 in closed position. Blade 30 can be moved out of closed position simply by pulling on it. However, the feel of locking pin 108 moving into second cutout portion 76 tells the user that blade 30 has moved fully into closed position. It will be evident that making second cutout portion 76 deeper than half the diameter of locking pin 108 will result in a locking of blade 30 in closed position. For some devices, this may be preferable than simply retaining blade 30 in closed position.

FIGS. 5 and 7 show certain details of pivot pin 92. In particular, pivot pin 92 is preferably a hollow rivet 130 received by hole 88. About the base of pivot post 86 is a depression 132 which, in the case of an integral, molded plastic pivot post 86, is believed to increase the wearability of the post. Pivot covers 64, 64' finish the appearance of handle 12.

First side 16 and second side 18 are preferably held together by gluing and surface-area increasing features such as a tongue and groove joint 136, as seen in FIGS. 5 and 6 and studs and holes 138 in thickened area 82 (FIGS. 3 and 7).

Figure 8:
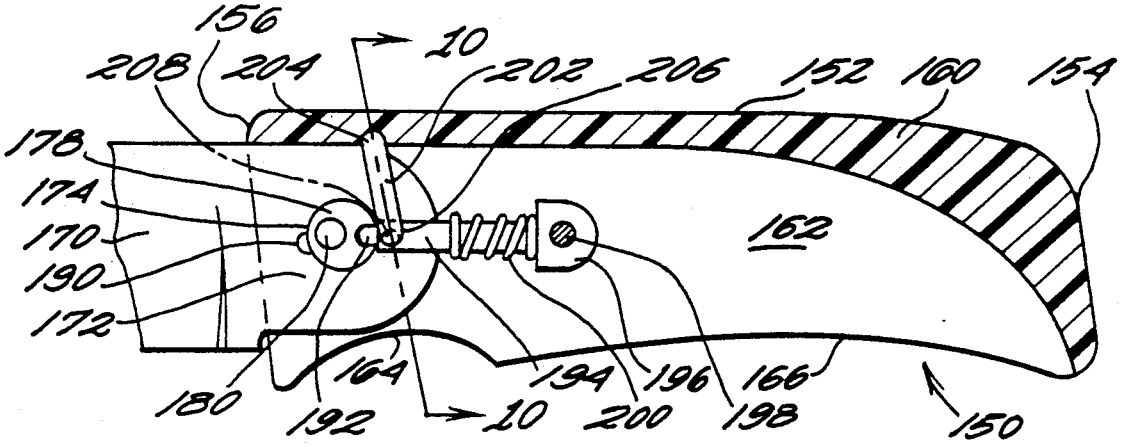
FIG. 8 is a cross sectional side view of the folding knife of FIG. 3 showing an alternative embodiment of the locking mechanism
Figure 9:
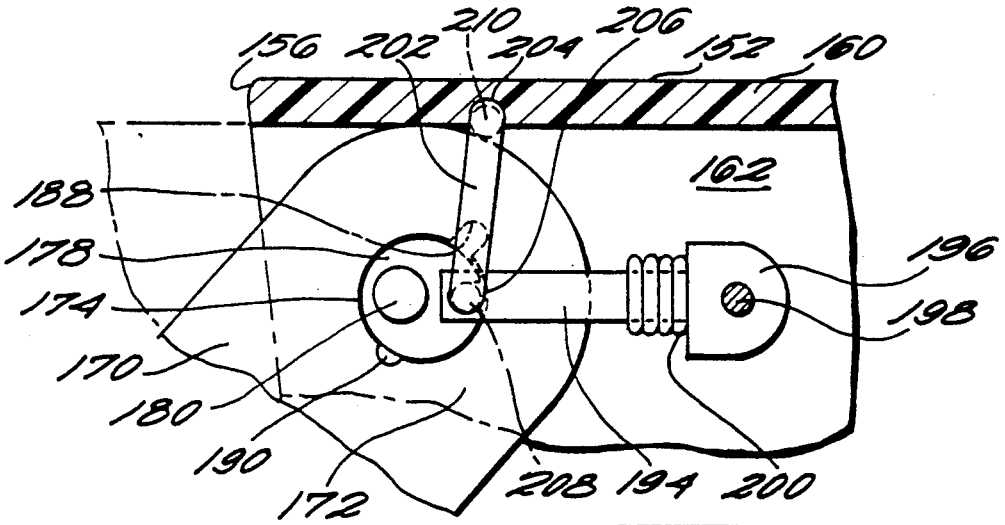
FIG. 9 is a detail of a cut away view of the alternative locking mechanism shown in FIG. 8 with the blade of the knife between the extended position and the closed position.
Figure 10:
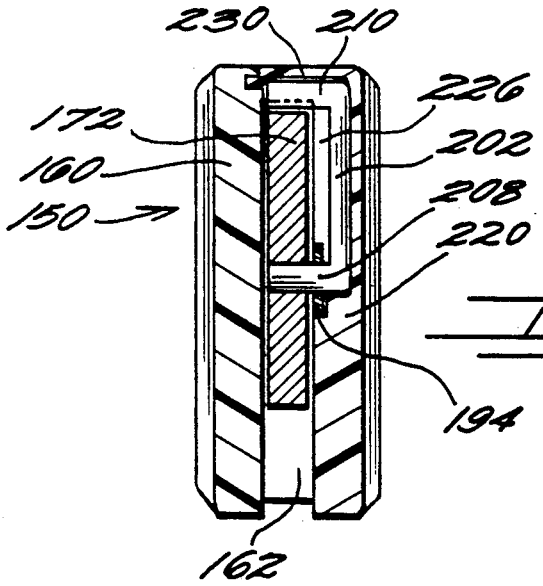
FIG. 10 is a cross sectional view along lines 10—10 of FIG. 8 showing the alternative embodiment of the locking mechanism.

FIGS. 8, 9, and 10 show an alternative embodiment of the locking mechanism. This particular embodiment provides additional stability and security in locking a blade when it is in the extended position. Consequently, it is especially well suited for knives with larger blades or heavier duty knives.

FIG. 8 is a cross sectional view of knife 150 in a view equivalent to that shown in FIG. 3. As in FIG. 3, second side 152 has a first end 156 and a second end 154, a thickened portion 160 and a groove 162 formed by first side (not shown in FIG. 8) and second side 152, blade 170 with tang 172 having hole 174 receiving pivot post 178. Pivot post 178 has hole 180 for a pivot pin (not shown in FIG. 8) and third cutout portion 192. Hole 174 has two cutout portions, a first, larger cutout portion 188 and a smaller, second cutout portion.

Riding in a recess 226 in first side 220, as shown best in FIG. 10, are the components of the locking mechanism. These include a transfer bar 194 with an enlarged head 196, a bolt pin 198, and coil spring 200. A strut 202 is added to this embodiment of the locking mechanism. Strut 202 has a first end 204 and a second end 206. First end 204 of strut 202 is pivotally carried in a transverse groove 230 formed in handle first side 220 (FIG. 10).

Second end 206 of strut 202 is rotatably attached to transfer bar 194. As best seen in FIG. 10, strut 202 has a locking portion 208 at second end 206 and a horizontal portion 210 at first end 204. Locking portion is pivotally attached to transfer bar 194. Horizontal portion is pivotally carried in transverse groove 230.

FIG. 8 shows the locking mechanism in locking position to hold blade 170 in the extended position, with strut 202 angled slightly so that second end 206 of strut 202 is toward second end 154 of second side 152, locking portion 208 seated in first cutout portion 188. FIG. 9, on the other hand, shows strut 202 angled by the forward motion of transfer bar 194 so that second end 206 of strut 202 is toward first end 156 of second side 152 and locking portion 208 is seated in third cutout portion 192.

It will be appreciated that strut 202 assists in holding blade 170 locked in extended position by resisting slippage of locking portion 208 from first cutout portion 188, its compressive strength against thickened portion 160 of second side 152 bracing horizontal portion 210.

It will be apparent to those skilled in the art of folding knives that modifications can be made in the preferred embodiments described in the foregoing without departing from the spirit and scope of the appended claims.

What is claimed is:

1. A device comprising:

a handle having two sides, a first end, a second end, and a groove running from said first end to said second end;

a pivot post integral with said first end of said handle;

an implement pivotally attached to said handle at said first end, said implement having a hole at one end, said hole dimensioned to receive said pivot post, said implement having an extended position and a closed position, said implement being in said closed position when pivoted about said pivot post into said groove of said handle, said groove dimensioned to receive said implement, said implement being in said extended position when pivoted about said pivot post out of said groove; and means for locking said implement in said extended position, said locking means carried within said handle;

a slidable bolt operable from at least one of said sides of said handle, said bolt slidable between a first position and a second position, said first position being toward said second end of said handle and said second position being toward said first end of said handle;

means for engaging said implement, said engaging means having an implement engaging position and an implement disengaging position, said implement prevented from pivoting about said pivot post when said engaging means is in said engaging position, said engaging means carried by said handle; and means for transferring sliding motion of said bolt to said engaging means so that said bolt can move said engaging means between said engaging position and said disengaging position, said engaging means in said disengaging position when said bolt is in said second position.

2. The device as recited in claim 1, further comprising means for retaining but not locking said implement in said closed position.

3. The device as recited in claim 1, further comprising means for retaining said implement in said closed position.

4. The device as recited in claim 1, wherein said locking means further comprises:

means for biasing said engaging means to said engaging position.

5. The device as recited in claim 1, wherein said handle has a contour means formed in said two sides of said handle for urging the user's thumb into a forward position on said handle toward said first end on one of two of said sides of said handle;

said locking means further includes a slidable bolt carried on said one of said two sides of said handle, said bolt positioned toward said second end so that the thumb must be away from said forward position near said first end and toward said second end to operate said bolt.

6. The device of claim 1 wherein said bolt slides between a first position and an opposing second position and said locking means further comprises:

means for engaging said implement, said engaging means having an implement engaging position and an implement disengaging position, said implement being prevented from pivoting about said pivot post when said engaging means is in said engaging position, said engaging means carried by said handle; and means for transferring sliding motion of said bolt to said engaging means so that said bolt moves said engaging means between said engaging position and said disengaging position as said bolt is moved between said first position and said second position.

7. The device as recited in claim 6 further comprising means for biasing said engaging means to said engaging position.

8. The device as recited in claim 1, further comprising means for retaining but not locking said implement in said closed position and wherein said handle has a contour means formed in said two sides of said handle for urging the user's thumb into a forward position on said handle toward said first end on one of two of said sides of said handle, and said locking means further comprises:

a slidable bolt operable from at least one of said two sides of said handle, said bolt slidable between a first position and a second position, said first position being toward said second end of said handle and said second position being toward said first end of said handle;

means for engaging said implement, said engaging means having an implement engaging position and an implement disengaging position, said implement prevented from pivoting about said pivot post when said engaging means is in said disengaging position, said engaging means carried by said handle; and means for transferring sliding motion of said bolt to said engaging means so that said bolt moves said engaging means between said engaging position and said disengaging position, said engaging means in said disengaging position when said bolt is in said second position.

9. A device comprising:

a handle having two sides, a first end, and a second end, said two sides defining a longitudinal groove;

a pivot post carried by said handle;

an implement pivotally attached to said handle at said first end, said implement having a hole at one end, said hole dimensioned to permit said implement to pivot about said pivot post, said pivot post in said hole, said implement having an extended position and a closed position, said implement being in said closed position when pivoted about said pivot post into said groove, said groove dimensioned to receive said implement;

a slidable bolt carried within said handle and operable from at least one of said two sides of said handle, said bolt slidable between a first position and a second position said first position being toward said second end of said handle and said second position being toward said first end of said handle;

means for engaging said implement, said engaging means having an implement engaging position and an implement disengaging position, said implement prevented from pivoting about said pivot post when said engaging means is in said engaging position, said engaging means carried by said handle;

means for transferring sliding motion of said bolt to said engaging means so that said bolt moves said engaging means between said engaging position and said disengaging position, said engaging means in said disengaging position when said bolt is in said first position; and strut means for supporting said engaging means, said strut means having a first end and a second end, said first end pivotally carried by said transferring means and said second end carried by a means formed in said handle for receiving said strut means so that said strut means supports said engaging means in said engaging position.

* * * * *